US008608430B1

(12) United States Patent
Liang

(10) Patent No.: US 8,608,430 B1
(45) Date of Patent: Dec. 17, 2013

(54) TURBINE VANE WITH NEAR WALL MULTIPLE IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 438 days.

(21) Appl. No.: 13/169,118

(22) Filed: Jun. 27, 2011

(51) Int. Cl.
*F01D 5/18* (2006.01)

(52) U.S. Cl.
USPC ..... 415/115

(58) Field of Classification Search
USPC ..... 415/115, 116; 416/96 R, 97 A, 97 R
See application file for complete search history.

(56) References Cited

U.S. PATENT DOCUMENTS 3,698,834 A * 10/1972 Meginnis ..... 416/96 R
4,565,490 A * 1/1986 Rice ..... 415/114
5,383,766 A * 1/1995 Przirembel et al. ..... 416/97 A
5,405,242 A * 4/1995 Auxier et al. ..... 415/115
7,488,156 B2 * 2/2009 Liang ..... 416/97 R
7,854,591 B2 * 12/2010 Liang ..... 416/97 R
8,182,223 B2 * 5/2012 Pal et al. ..... 416/96 A

* cited by examiner

*Primary Examiner* — Edward Look
*Assistant Examiner* — Liam McDowell
(74) *Attorney, Agent, or Firm* — John Ryznic

(57) ABSTRACT

A turbine vane with a low flow near wall multiple impingement cooling circuit in which a thin thermal skin is bonded over a main support spar that together forms a series of chordwise extending collection and impingement chambers extending from the leading edge region to the trailing edge region of the airfoil. Cooling air from a cooling air supply cavity flows through feed holes and into a first one of the collection chambers located in the leading edge region, and then through impingement cooling holes for backside impingement cooling of the airfoil wall. the series of collection and impingement is repeated along the airfoil wall until the spent impingement air is discharged through exit holes on both sides of the trailing edge region.

6 Claims, 6 Drawing Sheets

TURBINE VANE WITH NEAR WALL MULTIPLE IMPINGEMENT COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine stator vane with near wall cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Turbine stator vanes typically use an impingement insert to direct impingement cooling air from a supply channel to the backside surface of a hot wall surface of the vane. Stator vanes can use inserts because they are non-rotating airfoils as opposed to rotor blades. FIG. 1 shows a prior art turbine vane with an insert that provides backside impingement cooling for the entire airfoil. The airfoil 11 includes a pressure side wall and a suction side wall extending between a leading edge region and a trailing edge region with a cooling supply cavity 13 formed between the walls. An insert tube 12 includes impingement holes 14 that direct impingement cooling air to selected sections of the airfoil walls to provide for the backside impingement cooling. A number of stand-offs 15 are positioned to secure the insert tube 12 in place within the cavity 13.

In operation, cooling air from the supply cavity 13 flows through the impingement holes 14 in parallel to produce impingement cooling for the backside surface of the airfoil walls. The spent impingement cooling air is then collected within a passage 16 formed between the insert tube 12 and the airfoil inner walls and channeled toward the trailing edge region where the cooling air is then discharged through a row of trailing edge exit holes 17 that can include pin fins to enhance the heat transfer from the trailing edge region metal to the cooling air.

The FIG. 1 prior art vane cooling circuit requires a relatively high cooling flow rate because of the parallel arrangement of impingement cooling holes. The cooling air is spread out very thin in order to cover the entire backside of the airfoil. With this arrangement, the cooling of the hot gas surface area is very low. In a low flow cooling design, the spacing in-between the impingement holes are so far apart that the areas between impingement holes are without backside impingement cooling. Also, a continuous impingement cooling channel will also produce a cross flow effect and therefore degrade the impingement heat transfer coefficient and reduce the overall cooling effectiveness. Plus, a relatively thick airfoil wall will increase the conduction path of the impingement cooling air that will reduce the thermal efficiency for the airfoil backside impingement cooling. Other embodiments can have a rib that extends across the cavity to form multiple cooling air cavities each with a separate impingement place or insert.

BRIEF SUMMARY OF THE INVENTION

A turbine stator vane with a thin thermal skin bonded to an outer surface of a main support spar that forms a series of multiple impingement near wall cooling channels that extend from a leading edge region of the airfoil to the trailing edge region so that a low flow cooling circuit using impingement cooling for a vane can be formed. The series of near wall multiple impingement cooling channels extend from the inner endwall to the outer endwall to provide impingement cooling for the entire airfoil walls. With this design, a low metal temperature can be obtained so that a low flow cooling air can be used.

Cooling air flow through feed holes in the leading edge region along both the pressure side and suction side walls to produce impingement cooling for the leading edge region. The cooling air then flows through a series of spent air returns slots and then through impingement holes to produce impingement cooling of the backside surface of the airfoil walls. This series of impingement and return is repeated until the trailing edge region, where the cooling air is then discharged out exit holes on the pressure and suction side walls.

DETAILED DESCRIPTION OF THE INVENTION

Figure 2:
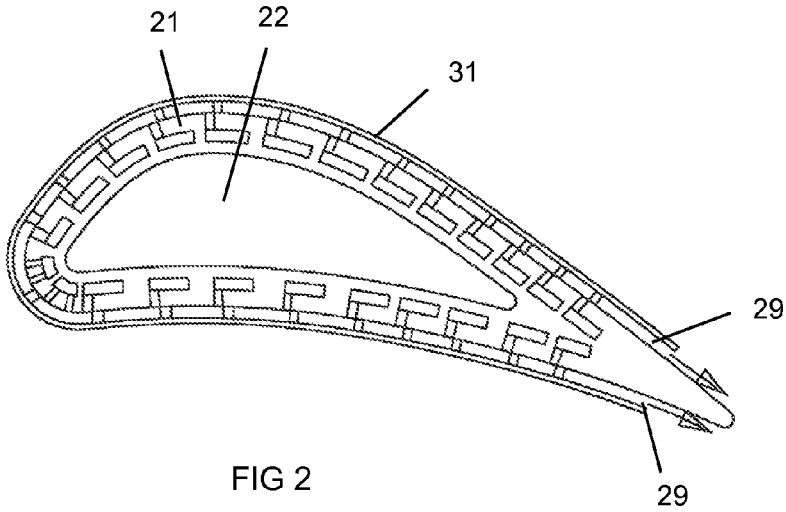
FIG. 2 shows a cross section top view of the near wall multiple impingement cooling circuit used in the vane of the present invention.

FIG. 2 shows the turbine stator vane of the present invention with a near wall multiple impingement cooling circuit that results in a relatively low metal temperature of the airfoil walls so that a low flow cooling amount can be used for the vane. The vane is formed with a main support spar 21 that has a shape of the airfoil but without the outer airfoil surface. The main support spar 21 forms a cooling air supply cavity 22 that supplied cooling air for the airfoil. A thin thermal skin 31 is bonded over the main support spar 21 to form the airfoil surface and to enclose the cooling circuit of the present invention. The thermal skin is bonded to the spar 21 using a transient liquid phase (TLP) process. Cooling air exit holes 29 are located on the pressure and suction wall sides near the trailing edge to discharge cooling air from the near wall impingement cooling circuits.

Figure 3:
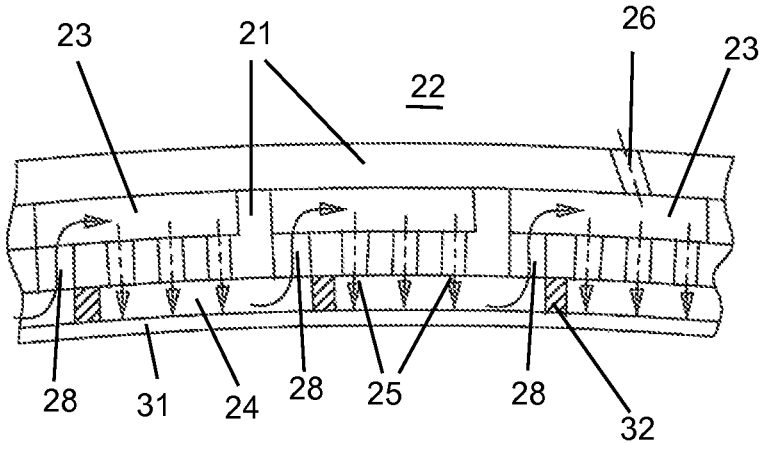
FIG. 3 shows a cross section top view of a section of the pressure side wall with three of the spent air collection chambers and three of the impingement chambers of the FIG. 2 vane cooling circuit.

FIG. 3 shows a detailed view of a section of the pressure side wall of the vane of the present invention. The main support spar 21 includes a series of spent air collection chamber 23 that extend from the leading edge region to the trailing edge region of the airfoil. The thermal skin 31 encloses impingement chambers 24 formed between the spar 21 and the thermal skin 31. A number of impingement holes 25 connect the collection chambers 23 to the impingement chambers 24. An upstream impingement chamber 24 is connected to a downstream collection chamber 23 through a spent air return hole 28. Some of the collection chambers 23 are connected to the cooling air supply cavity 22 through a resupply hole 26.

Figure 4:
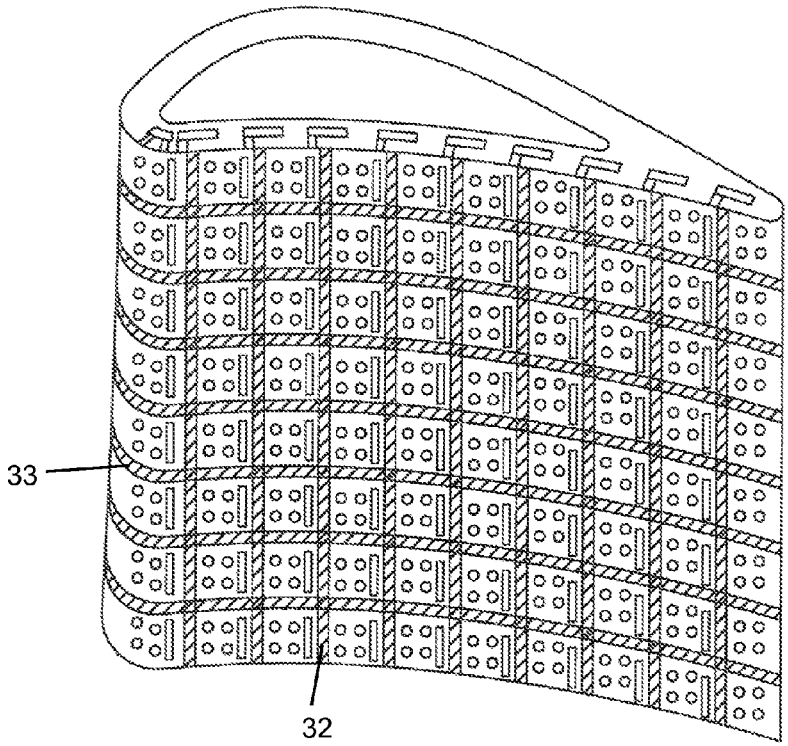
FIG. 4 shows a profile view of the vane cooling circuit of the present invention on the pressure side wall without the thin thermal skin.

The series of collection chambers 23 and impingement chambers 24 extends from the leading edge region to the trailing edge region as seen in FIG. 4 and. Each series is a closed near wall cooling passage and the series extends from the inner endwall to the outer endwall of the vane to cover the entire airfoil surface. The impingement chambers 24 are separated by chordwise extending ribs 32 and spanwise extending ribs 33. These ribs 32 and 33 form the support for the thin thermal skin that is bonded to the main support spar 21.

Figure 5:
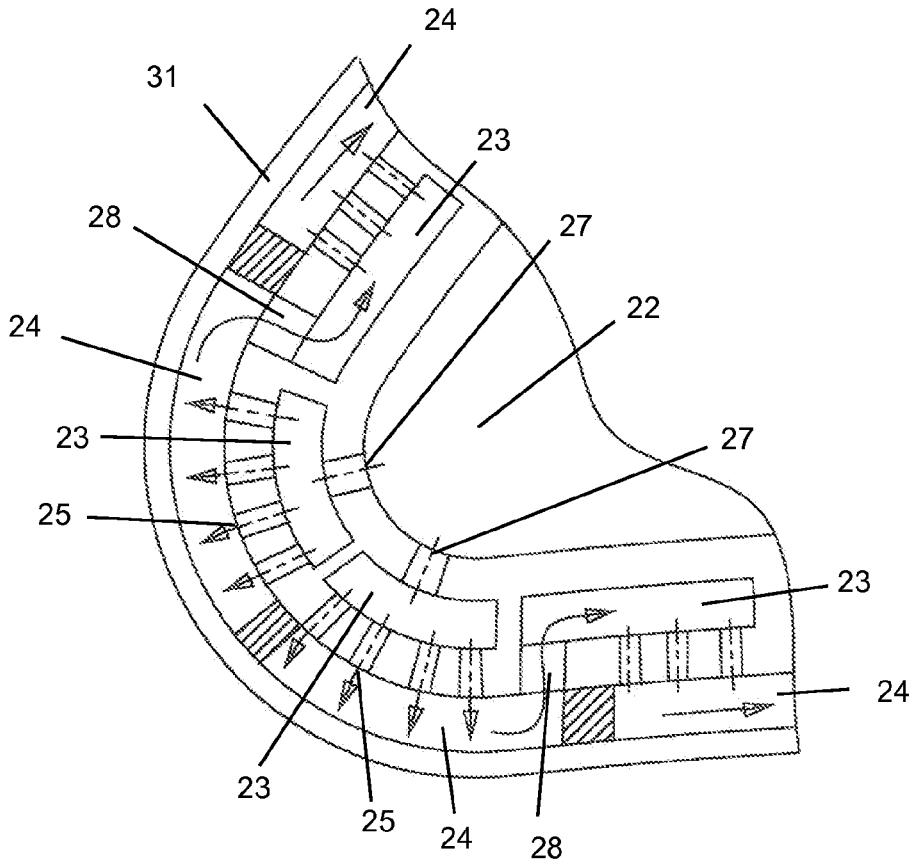
FIG. 5 shows an enlarged cross section top view of the cooling circuit of FIG. 2 in the leading edge region.
Figure 6:
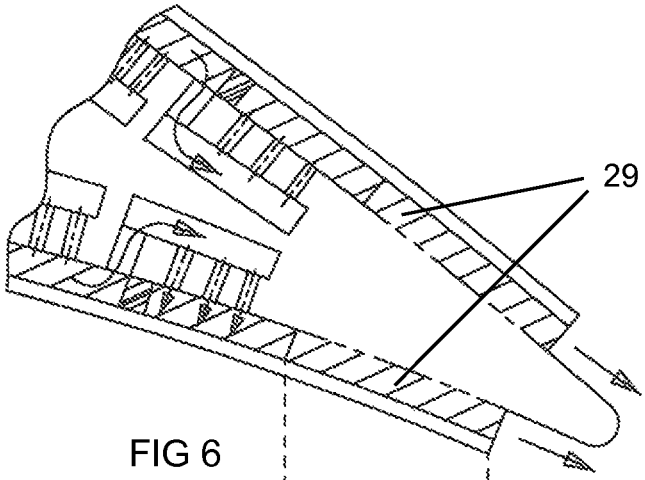
FIG. 6 shows an enlarged cross section top view of the cooling circuit of FIG. 2 in the trailing edge region.
Figure 7:
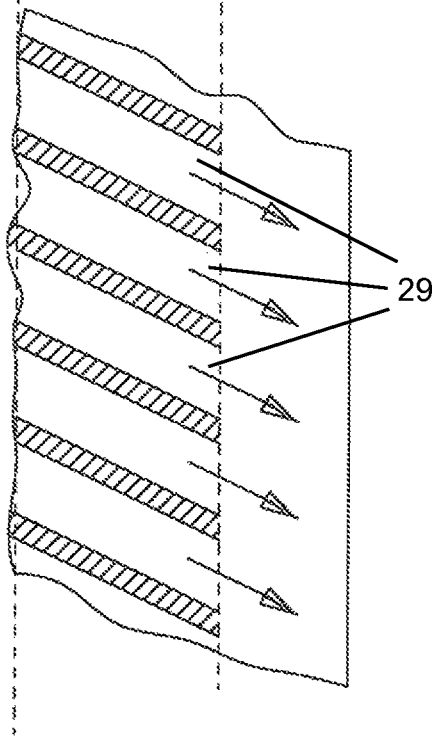
FIG. 7 shows a cross section side view of a section of the trailing edge region exit holes on the pressure side wall of the FIG. 2 vane.

FIG. 5 shows the leading edge region of the vane cooling circuit of the present invention with the cooling air supply cavity 22 connected by cooling air feed holes 27 to collection chambers 23 located on the pressure side and the suction side of the leading edge region. The collection chambers are connected to the impingement chambers 24 through the impingement cooling holes 25. The impingement chambers 24 located along the leading edge region are connected to return slots 28 that open into the next collection chamber 23 in the series. The collection chambers 23 then discharge cooling air through the impingement holes and into the next impingement chamber 24 downstream there from. This series is repeated along both pressure and suction side walls until the cooling air is discharged into the exit holes 29 located along the trailing edge region that discharges the cooling air from both sides of the airfoil.

Figure 1:
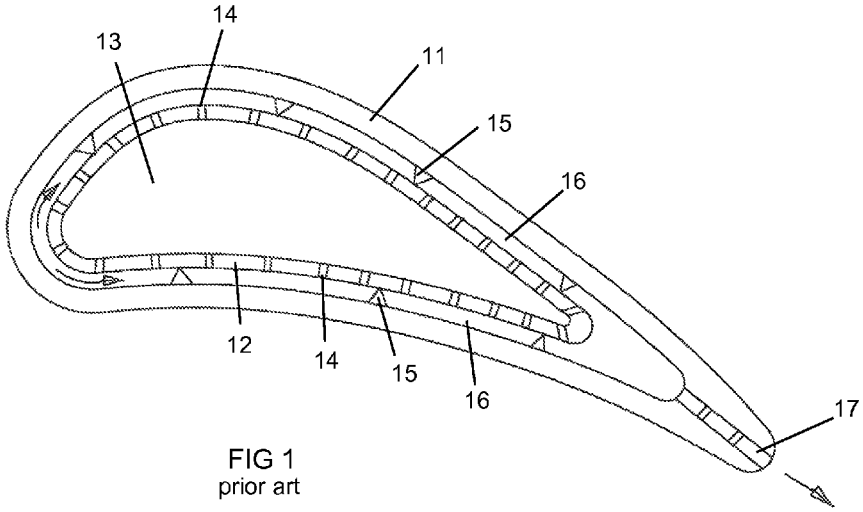
FIG 1 prior art
FIG. 1 shows a cross section top view of a prior art turbine vane with an insert tube that produces impingement cooling for the entire airfoil inner walls.

As seen in FIG. 4, the multiple impingement holes and cooling air return chambers are constructed in small individual cavity formation. Individual cavities are designed based on the airfoil gas side pressure distribution in both the chordwise and spanwise directions of the vane. In addition, each individual cavity can be designed based on the airfoil local external metal heat load to achieve a desired local metal temperature. The airfoil cooling circuit of the present invention yields a multiple layer cooling circuit in the chordwise parallel aft flowing formation. A maximum use of the cooling air is therefore achieved for a given airfoil inlet gas temperature and pressure profile. Multiple layers of cooling air in the chordwise channels with multiple impingement cooling yields a higher internal convection cooling effectiveness than in the prior art FIG. 1 vane. If no film cooling holes are used on the vane, each chordwise extending near wall multiple impingement cooling circuit that extends from the leading edge region to the trailing edge region forms a closed cooling circuit. No film cooling holes are preferred with the thin thermal skin so that a low flow cooling circuit can be formed. The refresh cooling air holes 26 can be used in selected collection chambers 23 to enhance the cooling.

The vane is constructed with the main support spar 21 cast with the collection chambers and the impingement chambers formed together during the casting process. The impingement cooling holes are then machined into the cast spar. The thin thermal skin is bonded over the spar using a transient liquid phase (TLP) bonding process. The thermal skin can be made from the same or a different material than the spar, and can be made using one piece to cover the entire airfoil surface or from several pieces. The thermal skin will have a thickness of from around 0.010 to 0.030 inches in order to allow for a low metal temperature with the near wall cooling circuits. This dimension is very difficult to achieve using modern lost wax casting processes because of the large number of defective castings.

I claim the following:

1. A turbine stator vane having an airfoil comprising:

a main support spar having an inner surface forming a cooling air supply cavity and an outer surface having a series of interconnected chordwise extending impingement chambers that extend from a leading edge region to a trailing edge region;

a collection chamber connected to each impingement chamber through a plurality of impingement cooling air holes;

a downstream collection chamber connected to an upstream impingement chamber through a return air slot;

a first cooling air feed hole connected to the cooling air supply cavity and to a first in a series of the collection chambers located on a pressure side wall of a leading edge of the airfoil;

a second cooling air feed hole connected to the cooling air supply cavity and to a first in a series of the collection chambers located on a suction side wall of the leading edge of the airfoil;

a first exit hole opening on the pressure side wall of the airfoil in the trailing edge region and connected to a last in the series of impingement chambers located on the pressure side wall; and, a second exit hole opening on the suction side wall of the airfoil in the trailing edge region and connected to a last in the series of impingement chambers located on the suction side wall.

2. The turbine stator vane of claim 1, and further comprising:

one of the collection chambers is connected to the cooling air supply cavity through a resupply hole.

3. The turbine stator vane of claim 1, and further comprising:

a thin thermal skin bonded over the main support spar to form an outer airfoil surface and to enclose the series of impingement chambers.

4. The turbine stator vane of claim 1, and further comprising:

a series of chordwise extending collection chambers and impingement chambers extending in a spanwise direction on the pressure side and suction side walls of the airfoil.

5. The turbine stator vane of claim 4, and further comprising:

the impingement chambers form a rectangular array on the main support spar along both the chordwise and spanwise directions of the airfoil.

6. The turbine stator vane of claim 1, and further comprising:

the collection chambers and the impingement chambers form a closed cooling air passage from a respective cooling air feed hole to a corresponding trailing edge exit hole.

* * * * *